US010952492B2

(12) United States Patent
Christian

(10) Patent No.: US 10,952,492 B2
(45) Date of Patent: Mar. 23, 2021

(54) PROTECTIVE COVER FOR CLEATED ATHLETIC SHOES

(71) Applicant: Jessie C. Christian, Washington, DC (US)

(72) Inventor: Jessie C. Christian, Washington, DC (US)

( * ) Notice: Subject to any disclaimer, the term of this patent is extended or adjusted under 35 U.S.C. 154(b) by 37 days.

(21) Appl. No.: 15/795,617

(22) Filed: Oct. 27, 2017

(65) Prior Publication Data

US 2018/0116330 A1 May 3, 2018

Related U.S. Application Data

(60) Provisional application No. 62/414,631, filed on Oct. 28, 2016.

(51) Int. Cl.

| | |
|---|---|
| ***A43B 5/18*** | (2006.01) |
| ***A43B 13/04*** | (2006.01) |
| ***A43B 13/14*** | (2006.01) |
| ***A43B 13/18*** | (2006.01) |
| ***A43B 13/32*** | (2006.01) |
| *A43B 1/00* | (2006.01) |

(52) U.S. Cl.

CPC ..... *A43B 5/185* (2013.01); *A43B 13/04* (2013.01); *A43B 13/141* (2013.01); *A43B 13/187* (2013.01); *A43B 13/32* (2013.01); *A43B 1/0072* (2013.01)

(58) Field of Classification Search

CPC ..... A43B 13/18; A43B 13/36; A43B 13/04; A43B 13/141; A43B 13/187; A43B 5/185; A43C 13/12

USPC ..... 36/135, 15, 7.3, 7.5, 7.6, 127

See application file for complete search history.

(56) References Cited

U.S. PATENT DOCUMENTS

| | | | | |
|---|---|---|---|---|
| D135,155 S * | 3/1943 | Huff | D2/916 | |
| D158,653 S * | 5/1950 | Fenlason | D2/916 | |
| 3,026,635 A * | 3/1962 | Slade | A43B 3/16 36/7.3 | |
| 3,040,451 A * | 6/1962 | Hilkemeyer | A43B 5/18 36/7.5 | |
| 3,263,348 A | 8/1966 | Cohen et al. | | |
| 4,484,398 A | 11/1984 | Goodwin et al. | | |
| 4,872,273 A | 10/1989 | Smeed | | |

(Continued)

FOREIGN PATENT DOCUMENTS

WO WO/03/043453 A1 5/2003

OTHER PUBLICATIONS

International Search Report dated Jan. 9, 2018, corresponding to PCT/US2017/058695.

*Primary Examiner* — Ted Kavanaugh

(74) *Attorney, Agent, or Firm* — Hogan Lovells US LLP

(57) ABSTRACT

A protective covering device for the bottom of an athletic shoe having cleats, spikes, studs, or other traction and stability-enhancing protrusions is disclosed. The covering protects against damage—to both cleats and hard surfaces underfoot—while at the same time being aesthetically pleasing and durable, fitting the profile of the shoe, and being easy to use. The protective covering also helps to avoid grass, dirt, mud and other foreign objects becoming stuck in the cleats. The protective covering may attach to the shoe in a variety of manners, including by cage or teeth-like gripping mechanisms, by side grips, by elastic band, by drawstring, adhesion, vacuum, or another mechanism.

14 Claims, 12 Drawing Sheets

(56) References Cited

U.S. PATENT DOCUMENTS

| | | | | | |
|---|---|---|---|---|---|
| 5,172,496 | A * | 12/1992 | Vemi | A43B 5/185 | 36/135 |
| 5,398,429 | A | 3/1995 | Olsen | | |
| D406,688 | S * | 3/1999 | Winters | D2/902 | |
| 7,631,440 | B2 * | 12/2009 | Keen | A43B 1/14 | 36/50.1 |
| 8,225,529 | B2 * | 7/2012 | Simms | A43B 5/185 | 36/7.1 R |
| 8,671,588 | B2 * | 3/2014 | Hampton | A43B 3/0078 | 36/7.1 R |
| 2008/0022555 | A1 | 1/2008 | Mor et al. | | |
| 2009/0100721 | A1 * | 4/2009 | Gorynski | A43B 5/185 | 36/135 |
| 2009/0249653 | A1 * | 10/2009 | Gunthel | A43B 3/0094 | 36/127 |
| 2009/0288314 | A1 | 11/2009 | Kay | | |
| 2010/0077638 | A1 * | 4/2010 | Simms | A43B 5/185 | 36/136 |

* cited by examiner

PROTECTIVE COVER FOR CLEATED ATHLETIC SHOES

CROSS-REFERENCE TO RELATED APPLICATION

The present application claims priority to U.S. Provisional Application 62/414,631 filed Oct. 28, 2016, which is hereby incorporated by reference in its entirety.

FIELD OF INVENTION

This invention relates to footwear protective devices that cover the bottoms of shoes or other footwear to prevent damage to the shoe or surface that the shoe comes into contact with. In particular, the invention is directed to protective covers for athletic shoes that have metal or plastic cleats, spikes, studs, and similar protrusions.

BACKGROUND OF THE INVENTION

Athletes participating in activities such as football, baseball, soccer, golf, softball, rugby, lacrosse, field hockey, cycling, and track often wear specialized shoes designed for the particular activity. These shoes may have cleats, spikes, studs, or other protrusions (shoes of this type are collectively known as "cleated shoes") to improve traction and stability on the soft surfaces where these activities take place, such as a grass or turf field. However, these protrusions are frequently made of metal, hard plastic, or hard rubber, and can be damaged and/or cause damage when they come in contact with hard surfaces underfoot, such as concrete, wood, or tile floors. The damage may include breaking or wearing down of the cleats, which can significantly shorten the lifespan of the shoes, requiring the wearer to purchase replacements more often than would otherwise be necessary. In addition, walking on surfaces such as wood flooring with cleats may cause dents or scratches to the floor.

Cleated shoes are a necessity to many athletes participating in athletic events, but given the risk of damage to their footwear, the athlete is left choosing between three unpleasant options: (1) allowing damage to his or her cleated shoes or the solid surface; (2) finding a softer surface to walk on; or (3) removing the footwear and changing into another pair of shoes. Oftentimes an athlete would rather accept the minor damage to his or her cleated shoes rather than spend time changing into a pair of cleat-less shoes just to walk from, for example, an athletic field to a locker room. This damage can build up over time, resulting in worn out shoes after a short period of time, perhaps after only one season. Monetary cost can also add up and be especially pertinent to high school athletes; a pair of high-quality, stylish cleats can carry a price tag of several hundred dollars. In addition to the damage to the cleats or hard surface, dirt, mud, and other debris can become lodged in the cleats. An athlete wearing cleats after an athletic activity can therefore track dirt into a car, home, locker room, school, or other location.

While several shoe protectors have been implemented to try to offer protection for cleated shoes, these typically require various straps or other attachment mechanisms to keep the cover fixed to the athletic shoe. These are often less appealing to a fashion-conscious athlete and sometimes difficult to attach to one's cleated shoes with convenience.

Consequently, there is a need for a protective covering for cleated athletic shoes that is low-profile, stylish, matches the profile of the shoe, and is easy to attach and remove.

SUMMARY OF THE INVENTION

The present invention relates to a protective covering device for the bottom of an athletic shoe having cleats, spikes, studs, or other traction and stability-enhancing protrusions, collectively referred to herein as cleats. The covering protects against damage—to both cleats and hard surfaces underfoot—while at the same time being aesthetically pleasing and durable, fitting the profile of the shoe, and being easy to use. The protective covering also helps to avoid grass, dirt, mud and other foreign objects becoming stuck in the cleats.

The covering fits onto to the bottom of a pair of cleated shoes, thereby reducing or eliminating damage to the cleats and to hard surfaces the user walks on. The protective coverings may be configured to fit on a particular style of cleated shoe, to ensure the protective covering adheres to the contours of the cleated shoe and fits tightly. Openings or recesses in the protective covering, configured to receive the cleats protruding from the bottom of a shoe, may be arranged in a specific pattern to match the pattern of the cleats or protrusions. Alternatively, openings or recesses may be provided for the longest of the cleats on the bottom of the shoe, or a soft material may be provided which adjusts to the shape and contours of the bottom of the shoe when attached. In addition, the protective coverings may be configured to match not only the contours and shapes of the protruding cleats, but to also match the contours and shapes of any other features on the bottom or sides of the athletic shoe to which they are attached. If any logos or distinctive designs are present on the shoe, these can be matched in the design of the protective covering to maintain a stylish and aesthetically pleasing appearance.

The cleated shoe may be attached to the protective covering in a variety of manners. For example, the covering may contain a semi rigid cage structure or teeth which grip the cleated shoe. This cage structure or teeth may be constructed of plastic, rubber, metal, or a malleable material that physically, mechanically, or adhesively attaches to the sides and/or bottom of the cleated shoe to hold the covering in place. The structure or teeth may be on the sides, front, and/or rear of the covering. Additionally or alternatively, the covering may include step-in grips such that the covering grips onto a cleated shoe when a user steps into the covering. This gripping mechanism may be flexible side grips that grip the side of the cleated shoe in the midfoot region of the shoe, which form a U-shape cross-section when viewing the covering from the rear. The curvature of side grips utilized in the U-shape configuration may vary depending on the size and design of cleated shoe in question.

The covering may also include a heel grip configured to fit around the heel region of the cleated shoe. The heel grip may be strap-shaped, cover the entirety of the heel, or only partially cover or otherwise attach to the heel. A toe grip, which fits or wraps entirely or partially around to the toe portion of the cleated shoe may also be present on the covering to facilitate attachment to the shoe. The toe grips, side grips, and heel grips may but do not necessarily connect from one side of the covering to the other, and may be elongated teeth-like structures. Depending on the structure of the cleated shoe, the grips may clip into or otherwise affix to the design elements of the shoe in a convenient manner for usability.

The covering may contain an elastic or drawstring closure which fits over the cleated shoe. This elastic or drawstring closure may narrow slightly in a region that extends up from the sole of the covering, which holds onto the shoe during movement utilizing friction. This upper region may be constructed of a fabric, mesh, polymer, or other materials that provide the desired functionality. This elastic or drawstring gripping closure may contain a portion with a high-friction or high-grip material such as a gel-lined band. The sole portion covering may be constructed from a different material the upper region that is durable for walking, such as the polymers or rubbers used in traditional non-cleat athletic shoes.

Other variants of the protective covering may be configured to mold uniquely to a particular athlete's cleated shoe. For example, the covering may include a low-temperature thermoplastic on the shoe-facing side. The user would heat the covering to the appropriate temperature (e.g., boiling, similar to "boil-and-bite" mouth guards commonly used in American football and other sports) and step into the thermoplastic with the desired cleated shoes to make an individualized mold in the covering that matches the bottom of the shoe. These coverings could be re-boiled to and re-fit to the cleated shoes if the covering loosens over time. Another moldable variant of the protective covering may include on the shoe-facing side a thermosetting material such as an epoxy resin, foam, silicone, or other soft material that hardens over time. A user would prepare the soft material on the shoe-facing side, such as by mixing two components of an epoxy resin, applying the soft material to the shoe-facing side of the protective covering, and stepping into the soft material with the cleated shoe to make an individualized mold in the covering that matches the bottom of the shoe. A third moldable variant of the protective covering may include a heat-shrink grip structure that extends up from the sole of the covering, which wraps around and holds onto the shoe during movement utilizing friction. These moldable variants of the protective covering are thus compatible with a wide variety of cleated shoes without needing custom configurations for each shoe design. To increase compatibility, these moldable variants may be cut-to-size or otherwise adjustable to a variety of sizes and shapes of cleated shoes.

The protective coverings may be implemented for a wide variety of athletic shoe styles, including but not limited to football cleats, soccer cleats, baseball cleats, rugby cleats, golf shoes, softball cleats, lacrosse cleats, field hockey cleats, cycling shoes, and track spikes. A tight fit is preferred for the protective covering to maintain adhesion and attachment to the cleated shoe during walking and other movement. This tight fit may be achieved by vacuum, friction, or attachment mechanisms. For example the profile and shape of the protective covering may be designed to match the profile and shape of the bottom portion of the shoe to which it will be attached. The protective covering may be partially or completely translucent or transparent to allow the aesthetic design of the cleated shoe to show through the covering and is visible through the covering. The shoe-facing side of the covering may have the same shape as the bottom of the shoe, with indentions, recesses, holes, or other materials provided to accept or cushion the protruding cleats. In addition, the shoe-facing side may be configured to tightly fit the contours of the side of the bottom portion of a shoe, thus keeping the protective covering firmly attached. The covering may also include adhesive material to enable the covering to adhere to the bottom of a cleated shoe, such as high-adhesion gel padding that is washable and compatible with a range of temperatures in which the protective covering may be used, from around 0° F. to 150° F., depending on weather and sun conditions. The adhesive material may be used with the other embodiments for attaching the covering to the cleated shoe, or it may be used by itself to attach a cover to the cleated shoe. Flexibility is also preferred for the protective covering to flex with the cleated shoe during walking or other movement without becoming detached. The protective coverings can be made of flexible materials, including rubber, plastic foam, or high density stretch fabric. The outsole ground-facing side of the protective covering may be configured to provide traction and constructed out of materials that enhance grip without causing damage to ground surfaces, such as the rubber or elastomers utilized in traditional non-cleat athletic shoes.

The present invention easily attaches to the bottom of a cleated shoe. One method of attaching the protective covering is by placing it on the ground and stepping into the protective covering, thereby attaching it to the bottom of the shoe. Another method of applying the protective covering is to attach the covering to the bottom of one's cleated shoe by hand. A pull tab, loop, or other structure may be present on the front, rear, or sides of the protective covering to facilitate a user's ease of application to the bottom of the cleated shoe. These methods, among others, are meant to be quick and simple compared to unlacing and changing into another pair of shoes.

DETAILED DESCRIPTION OF A PREFERRED EMBODIMENT

Figure 1:
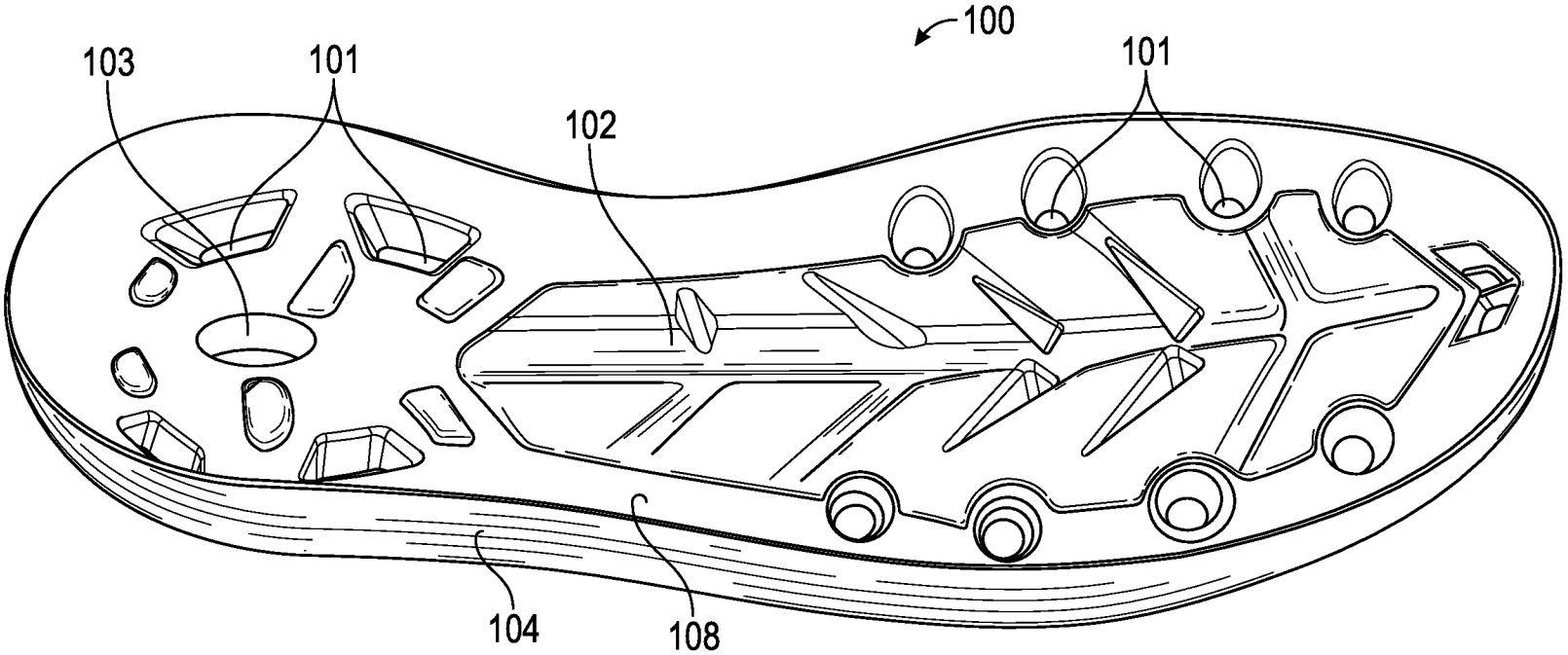
FIG. 1 is a three dimensional top view of a protective covering.

FIG. 1 is a three dimensional top view of a protective covering 100, which may be formed out of a variety of flexible materials including but not limited to rubber, plastic foam, or high density stretch fabric. The protective covering 100 contains holes or recesses 101 to receive the metal or plastic cleats, studs, spikes, or other protrusions (collectively "cleats") from a shoe having such protrusions (a "cleated shoe"). The top portion of the protective covering 100 may also be formed to receive any non-cleat protrusions on the bottom of the shoe, such as formations to receive logos 103 and formations to receive other design features 102. These formations may be holes, recesses, or materials that flex to accept the logo or design formations of the shoe. By forming the protecting covering to match both the cleats and non-cleat protrusions, the protective covering adheres tightly to a cleated shoe while maintaining the distinctive design of the shoe itself. The outer side 104 of the protective covering 100 is visible when the protective covering 100 is attached to a cleated shoe and may be stylized in a variety of ways, preferably to match the aesthetics of the cleated shoe. The shoe-facing footbed 108 receives the bottom of a cleated shoe 205 to protect the cleated shoe 200 from damage and provide cushioning between the shoe 200 and any ground surface a user walks on. The protective covering may also be formed with designs or logos not included on the shoe itself, allowing the covering to alter the outward appearance of the shoe when attached.

Figure 2:
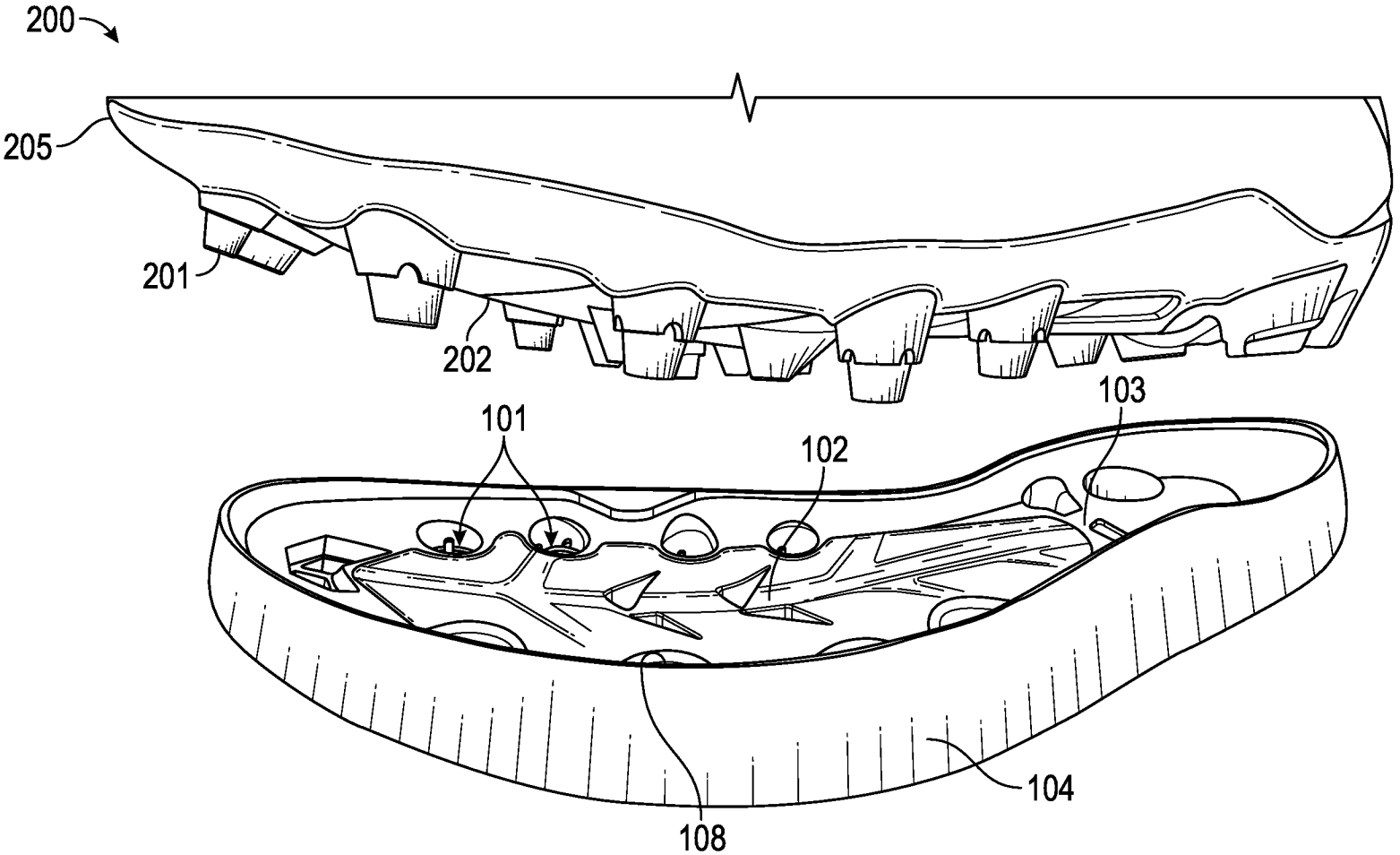
FIG. 2 is an illustration showing how a cleated shoe would align with and fit into a protective covering.

FIG. 2 is a three dimensional view of the protective covering 100 aligned with the bottom of a cleated shoe 200. The holes or recesses 101 of the protective covering 100 are configured to mate with the cleats 201 on the bottom of the shoe 200, thereby creating a tight fit. The holes may be dimensioned to receive the cleats to a certain depth, such that the cleats do not protrude from the bottom of the protective covering. Similarly, the recesses may be dimensioned to receive the cleats such that they do not protrude from the bottom of the protective covering, and may be further dimensioned to provide a predetermined amount of the material forming the protective covering between the cleat and the bottom of the protective cover. This predetermined amount of material provides cushioning and separation between the cleat and underlying surfaces that the wearer comes in contact with, thus protecting both the cleat and the underlying surface. The formations for receiving logo features 103 and for receiving other shoe design features 102 on the top of the protective covering 100 fit onto the logo features 203 and design features 203 on the bottom of the cleated shoe 200, preferably forming a tight fit. The outer side 104 of the protective covering preferably fits snugly against an upper portion 204 of the cleated shoe 200 to mimic the aesthetics of cleat-less athletic shoes, such as basketball shoes. The bottom of the protective covering may be formed of a flexible material, or alternatively may be formed of a rigid or semi-rigid material. For example, the bottom portion may be formed of a plastic or hard rubber that provides enhanced protection while still being flexible enough to move with the shoe.

The protective covering 100 may be produced based on a 3D or geometrical scan of the cleated shoe 200 that it is designed to fit, obtained via laser, modulated or structured light, or other scanning technology known in the art. Molds of the bottom portion of a shoe may also be created, and the protective covering may be formed using the molds. The protective covering may be configured to correspond to all cleats, designs, logos, and contours of the shoe, or may be configured to correspond to only select features of the shoe. For example, the protective cover may be configured to only include recesses or holes for accepting all cleats on the shoe, without any recesses to correspond to logos or design features of the shoe. The protective cover may also be configured to only correspond to certain of the cleats on the bottom of the shoe, such as the longest cleats, while not having corresponding holes or recesses for shorter cleats. In addition, the protective covering may include a soft material contacting the cleats, allowing the cleats to sink in without protruding from the bottom of the protective covering.

The protective covering 100 may be applied to the bottom of a cleated shoe 200 in a variety of ways. A user may press the protective covering 100 onto the cleated shoe 200, applying enough pressure for the two to fit together. A user may place the protective covering 100 on the ground and step onto it while wearing his or her cleated shoes, thereby applying enough pressure for the two to fit together tightly. The protective covering may be made of a flexible material, allowing a user to stretch the flexible cover in order to firmly secure it around a shoe.

Figure 3:
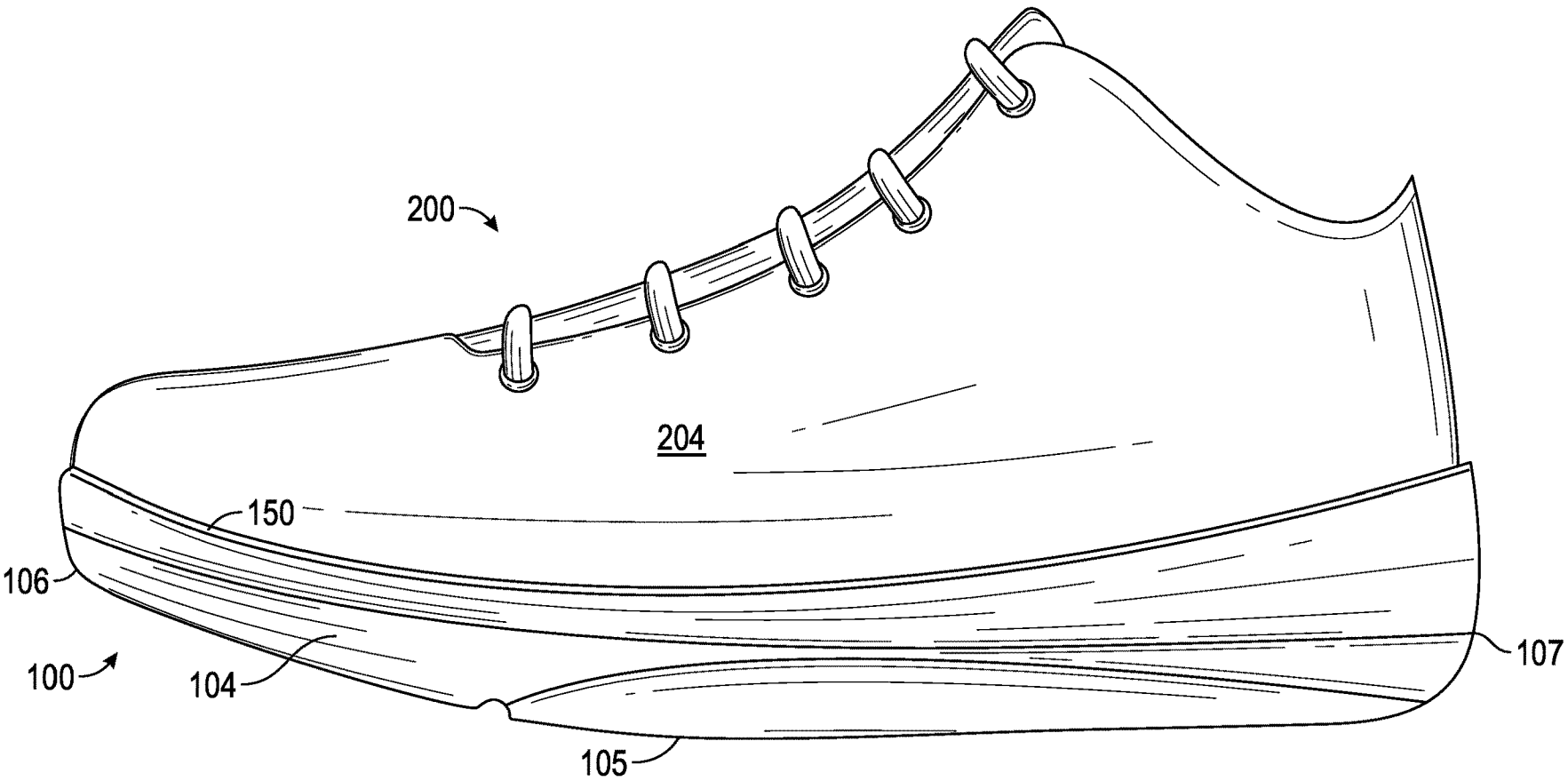
FIG. 3 is a side view of a protective covering attached to the bottom of a cleated shoe.

FIG. 3 is a side view of the protective covering 100 attached to the bottom of a cleated shoe 200. The outer side 104 of the protective covering 100 may attach closely to an upper portion 204 of the cleated shoe 200, illustrated by the seam 150 between the upper portion 204 and the outer side 104 of the protective covering. The upper portion 204 may include the midsole, outsole, sole, upper, and sides of the shoe. The upper portion may extend up the side of the shoe to any amount desired, and may encompass the entirety of the shoe if desired. The design of the outer side 104 of the protective covering may vary depending on the style and function of the cleated shoe 200. The outer side 104 of the protective covering may be smooth, or may be designed to match the shoe's aesthetics. For example, the outer side 104 of the protective covering may include designs that match the designs on any portion of the shoe which it covers, or may include additional designs or markings not found on the shoe. By providing different designs and markings from what is included on the shoe, a user may select protective coverings to change the appearance of their shoes as desired. For example, a user may select from among different protective coverings 100 to change the color or appearance of his or her shoes to match their outfit (such as special home or away jerseys). Furthermore, the curvature of the bottom of the toe section 66 of the protective covering and the heel section 77 of the protective covering may preferably vary according to the functionality desired, and may match the aesthetics or style of the cleated footwear.

Figure 4:
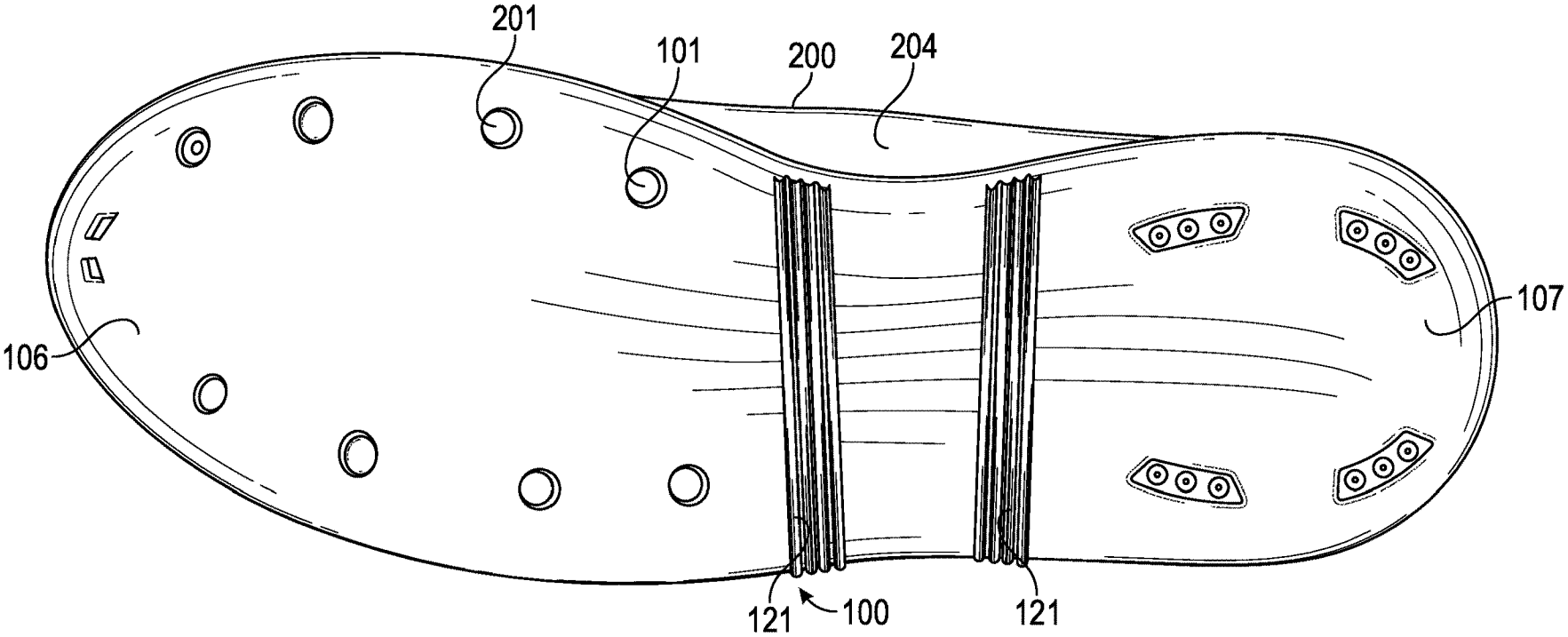
FIG. 4 is a bottom view of a protective covering attached to the bottom of a cleated shoe.

FIG. 4 is a bottom view of the protective covering 100 attached to the bottom of a cleated shoe 200. The holes or recesses 101 of the protective covering 100 are shown to fit tightly over the cleats 201 of the cleated shoe 200. The formation to receive design features 203 that are holes are visible on the bottom of the protective covering 100. The bottom portion 105 of the protective covering that comes in contact with the ground may be textured for improved traction. As noted above, the bottom of the protective covering may be formed of the same flexible material as the rest of the protective covering, or it may be formed of a rigid or semi-rigid material that differs from the rest of the protective covering. The bottom portion 105 that comes in contact with the ground or other underlying surface may also be designed such that it matches some or all of the appearance of the bottom of the shoe to which it is attached. Stretch areas 121 are depicted on the bottom of the protective covering 100 which allow the covering to stretch, expand longitudinally, bend, and flex while being applied to a cleated shoe 200 and during movement. The protective covering 100 may include rigid materials on the side portions of the protective covering 104. The rigid materials used in the protective covering 100 may be configured to similarly expand, bend, and flex to facilitate stretching, flexion and extension of the stretch areas. The rigid materials may be positioned on the side portions 104 and may have thin regions to allow for this expansion, bending, and flexing. The thin regions may align with the stretch areas 121 or be used independently at locations where the protective covering flexes during walking, such as a midfoot section between the toe section 106 and heel section 107 of the protective covering. These stretch areas 121 and rigid materials with thin areas on the side portions 104 may be utilized with other embodiments of the protective covering.

To effectively remove the protective covering 100 from the cleated shoe 200, a user may pull on a variety of sections of the protective covering. For example, a user may pull on either the toe section 106 or the heel section 107 to remove the protective covering.

Figure 5:
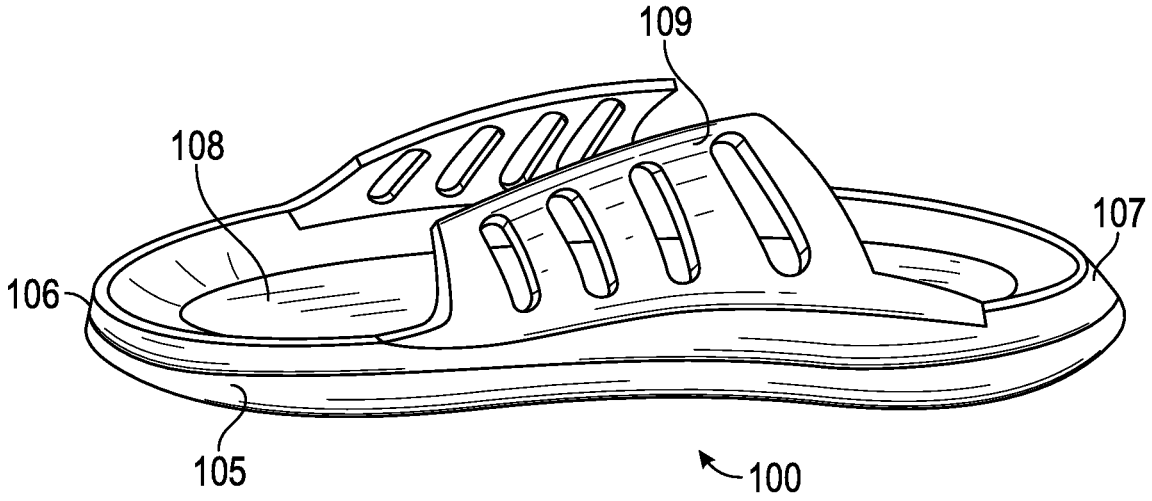
FIG. 5 is a side view of a protective covering having semi-rigid cage structure wraps.

FIG. 5 is a side view of a protective covering 100 having semi-rigid cage structure wraps 109 which grip a cleated shoe 200 when a user steps into or otherwise applies the covering 100. The semi-rigid cage structure wraps 109 may be made of or contain plastic, rubber, metal, wood, or another material which retains its shape sufficiently well to grip a cleated shoe 200. The gripping may occur mechanically by friction, adhesively, or another mechanism. The shoe-facing footbed 108 of the protective covering may optionally contain structures to receive the cleats 101 and other formations on the bottom of the cleated shoe 102 or otherwise be configured to cushion the cleated shoe 200 while attached, such as being constructed of a soft material to receive the cleats 201.

Figure 6B:
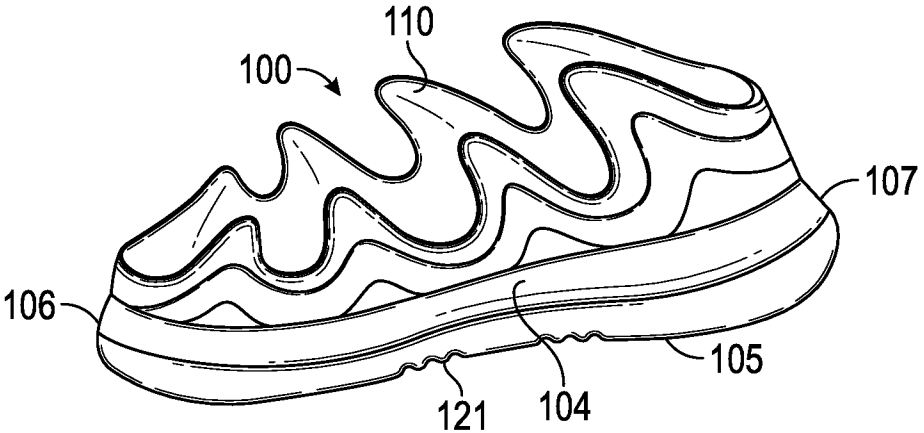
FIGS. 6A-6C are side, perspective, and front views of a protective covering having teeth gripping structures.
Figure 6C:
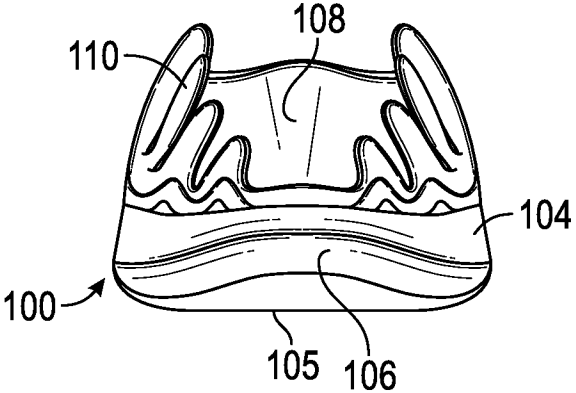
Figure 6A:
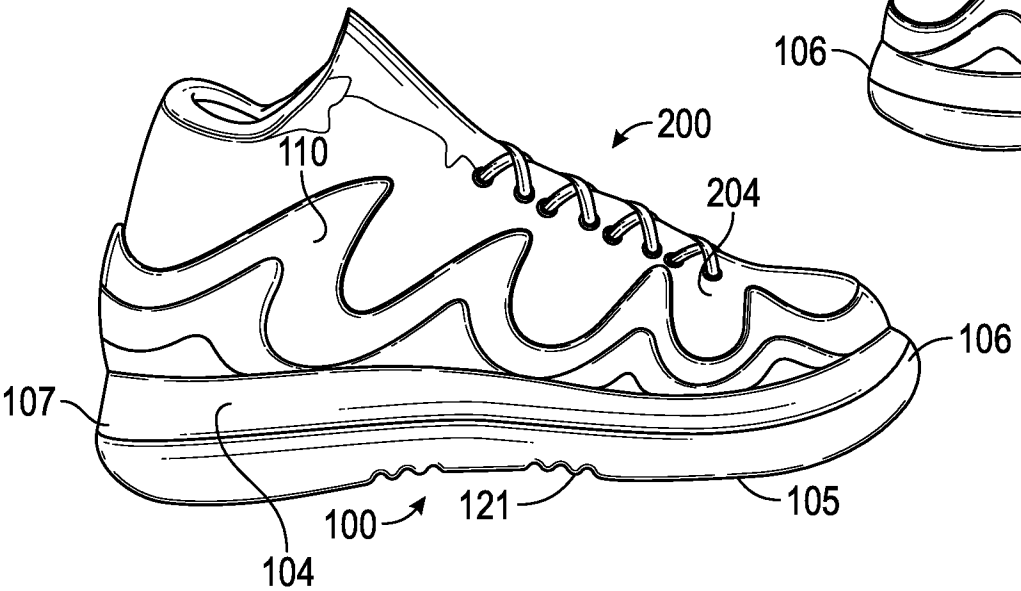
Figure 13:
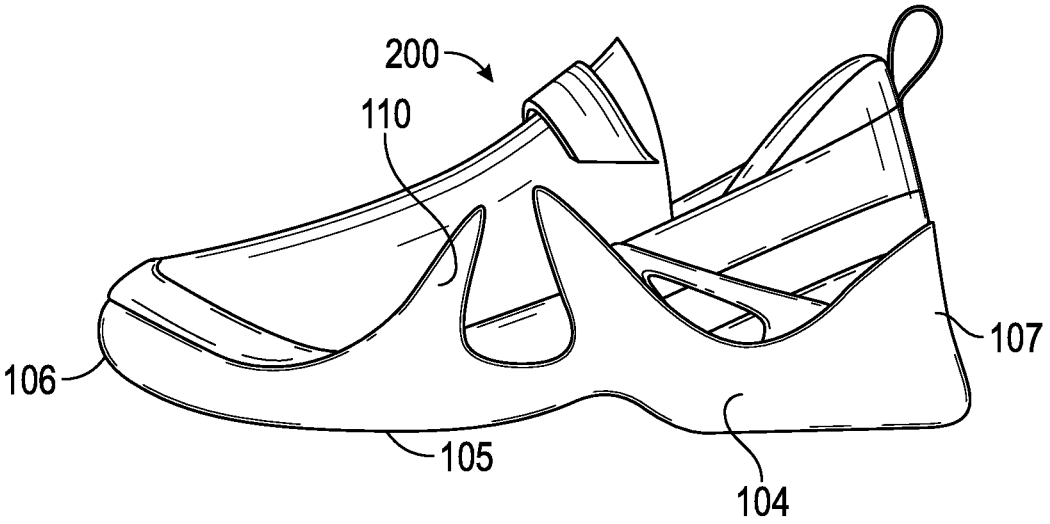
FIG. 13 is a side view of a protective covering having teeth structures.

FIG. 6A-6C are side, perspective, and front views of a protective covering 100 having teeth gripping structures 110. In FIG. 6A, a cleated shoe 200 is received into the shoe-facing footbed 108 of the protective covering 100, such that only the upper portion of the cleated shoe 204 is visible. Teeth gripping structures 110 may be configured to hold the protective covering 100 onto the cleated shoe by friction, adhesively, or another mechanism. The teeth 110 may be rigid or partially malleable, and may extend entirely or only partially over the upper portion of the cleated shoe 204. The teeth 110 may be constructed of a single material or overmolded with an embedded more rigid material, such construction materials may be rubber, metal, wood, fabric, plastic, or elastomer. Depending on the teeth 110 length, a user may apply the covering 100 manually or by stepping into the protective covering 100. As depicted in FIGS. 6B and 6C, the teeth 110 may be arranged in rows on the protective covering 100, potentially protruding up from the side portions of the protective covering 104. The teeth 110 may vary in length depending on aesthetics or the general design of the cleated shoe 200, and the teeth 110 may be longest near the rear section of the protective covering 107 with each succeeding teeth gripping structure 110 in the row towards the front section 106 being shorter than the previous teeth gripping structure 110 in the row, such that the shortest teeth gripping structures 110 are nearest to the toe section of the protective covering 106. The teeth 110 and covering 100 may be transparent or translucent to reveal the design, logo, and aesthetics of the cleated shoe 200 while attached. Stretch areas are depicted on FIG. 6A. FIG. 13 is a side view of another protective covering having teeth gripping structures having a different design and being affixed to a different style of shoe. The teeth gripping structures 110 may run along only a portion of or the entirety of the sides, front, or rear of the protective covering. The teeth gripping structures may be positioned at the midfoot region and angled toward the toe section of the protective covering 106. The protective covering 100, as illustrated in of FIG. 13, may also contain a toe cap portion at the toe section of the protective covering 106 that wraps around and holds the cleated shoe and/or a raised portion at the rear of the protective covering 107 that wraps around and holds the cleated shoe 200, to facilitate grip or adhesion to the cleated shoe 200. The toe cap portion at the front of the protective covering 106 and the raised portion at the rear of the protective covering 107 may be constructed of single piece or made up of a plurality of teeth gripping structures 110.

Figure 7:
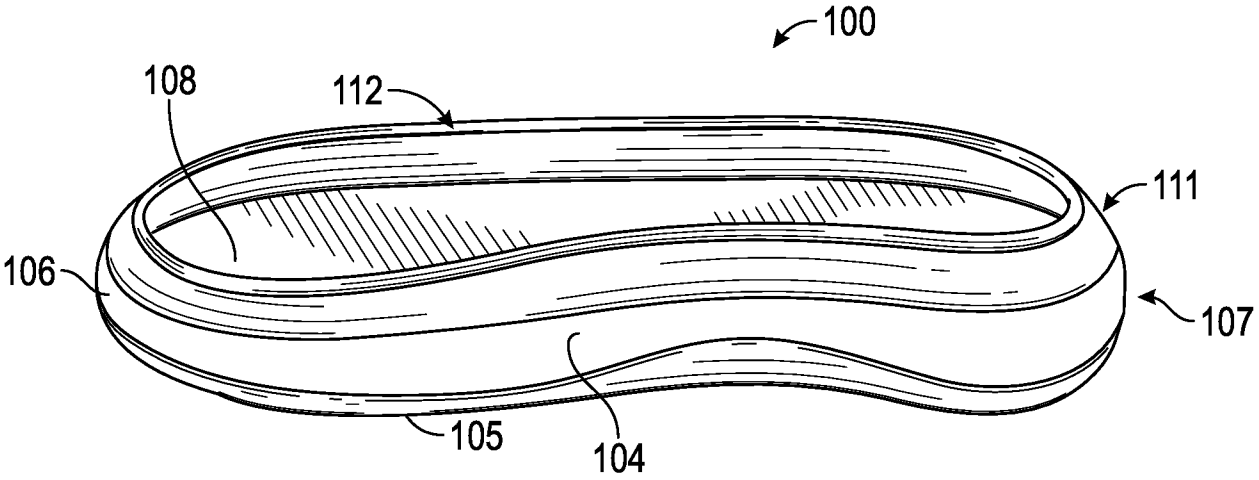
FIG. 7 is a side view of a protective covering having an elastic band grip structure.
Figure 9B:
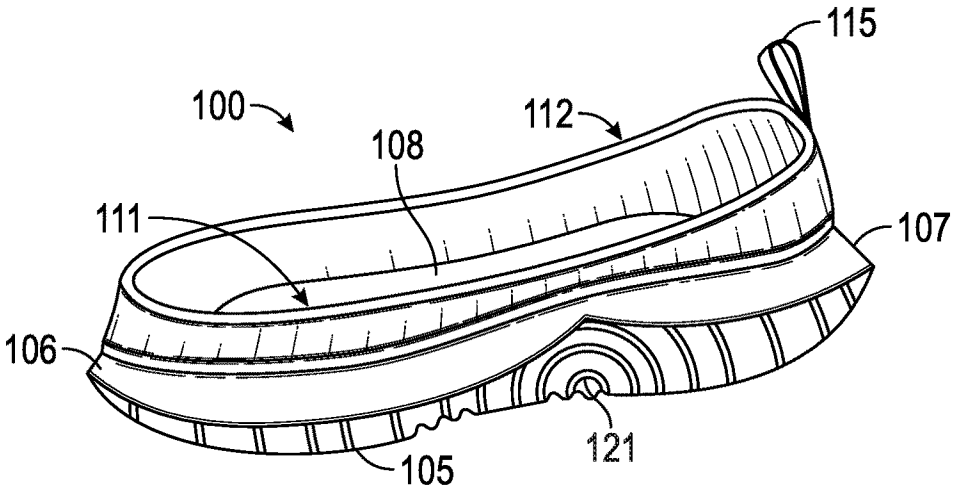
FIGS. 9A-9C are side, perspective, and front views of a protective covering having an elastic band grip structure.
Figure 9C:
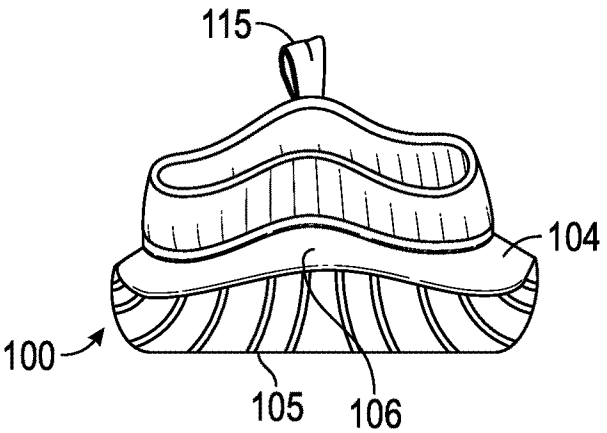
Figure 9A:
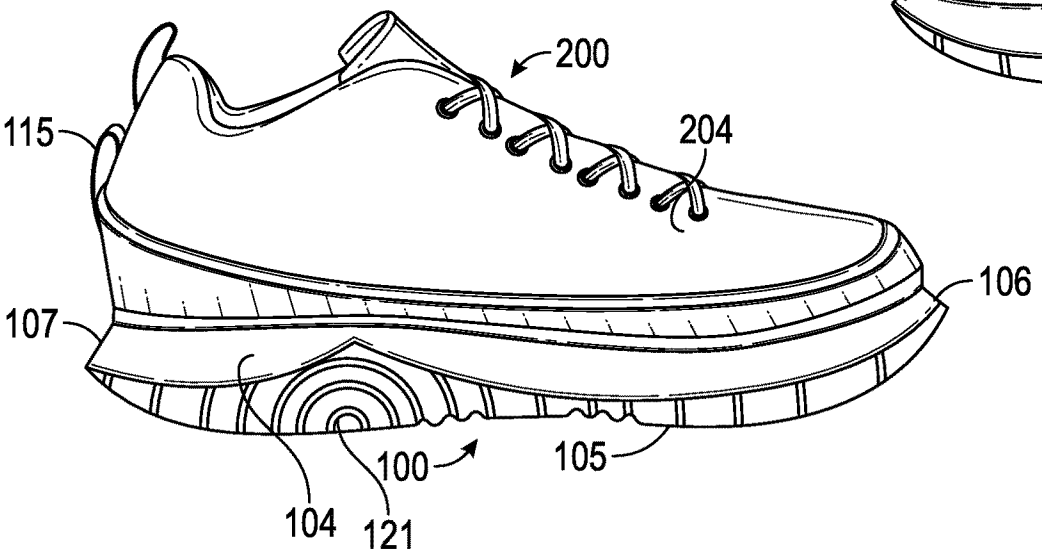

FIG. 7 is a side view of a protective covering 100 having an elastic band grip structure 111. The elastic band grip structure 111 extends up from the outer sides of the protective covering 104 and narrows elastically to hold a cleated shoe 200 when inserted into the protective covering. The elastic band grip structure 111 may include a high-friction material 112, such as an adhesive gel, where the elastic band grip structure 111 is configured to come into contact with the cleated shoe 200 to increase friction between the two and form a strong hold. FIGS. 9A-9C also illustrates a side, perspective, and front view of a protective covering 100 having an elastic band grip structure 111. FIG. 9A illustrates how the elastic band grip structure 111 fits around the body of the cleated shoe 200. FIGS. 9B and 9C depict how the elastic band grip structure extends from the protective covering 100 radially in a manner that fits around a cleated shoe 200. The portion of the elastic band grip structure 111 near the front of the protective covering 106 may fit over the toe portion of the shoe, and the portion of the elastic band grip structure 111 near the rear of the protective covering 107 may fit over the heel of the cleated shoe 200. The elastic band grip structure 111 may be constructed out of a breathable mesh, plastic, rubber, fabric, or another appropriate material. FIGS. 9A and 9B depict stretch areas 121 which are configured to stretch, expand, or flex radially when the protective covering 100 is applied to a shoe or during movement. These radial stretch areas 121 may be utilized with other embodiments of the protective covering to facilitate stretching, flexion and extension of the stretch areas. The protective covering 100 may include one or more loops 115, tabs, or other structures a user can pull to facilitate applying the protective covering 100 to a cleated shoe 200. These loops 115 may be positioned at convenient locations on the protective covering 100, such as at the rear 107, at the front 106, outer sides 104, or another location. The loops 115 may double as hangers and be positioned in the shoe-facing footbed 108 or on the bottom of the protective covering 105 to aid in the removal of the protective covering 100 or for use when the protective covering 100 is not attached to a cleated shoe.

Figure 8:
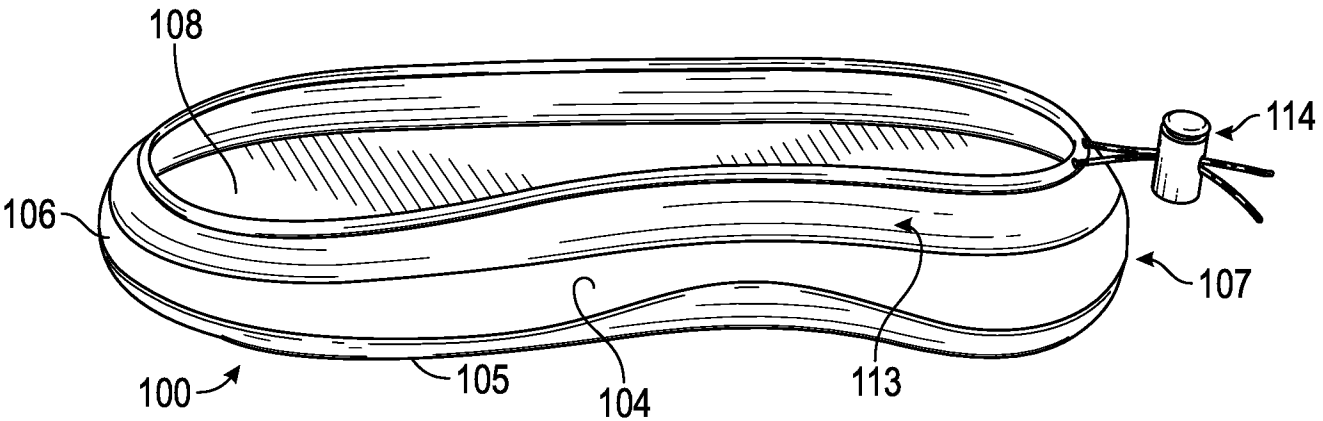
FIG. 8 is a side view of a protective covering having a drawstring grip structure.

FIG. 8 is a side view of a protective covering 100 having a drawstring grip structure 113 which extends up from the outer sides of the protective covering 104. The drawstring grip structure 113 narrows when the drawstring is tightened to hold tightly onto the cleated shoe 200. As with the elastic band grip structure 111, a high-friction material 112 may be present on or in the drawstring grip structure to ensure a tight hold to the cleated shoe 200. The protective covering 100 may include a drawstring slide lock 114 to hold the drawstring in place when tightened. The lock 114 may be positioned at the front 106, rear 107, along the side 104, or at any other location on the protective covering 100.

Figure 10B:
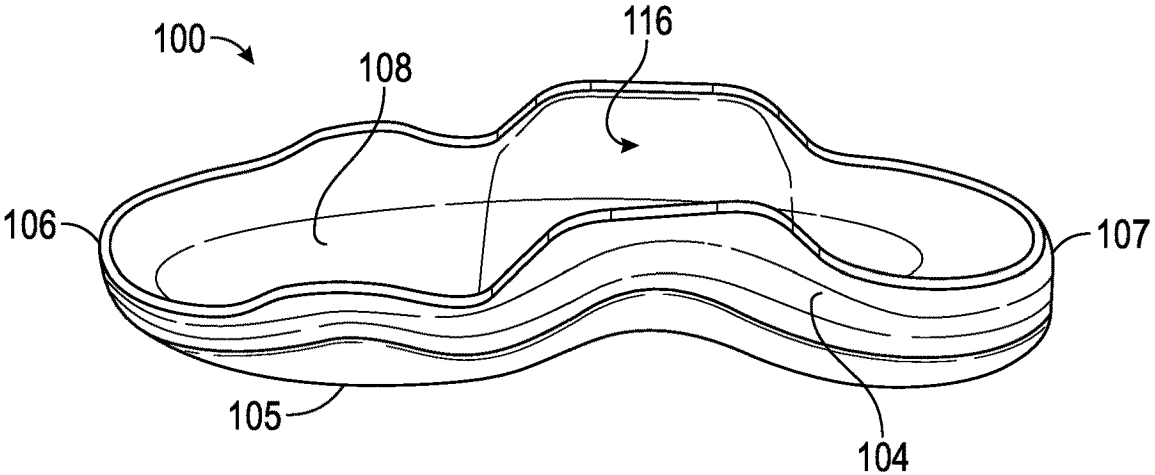
FIG. 10A-10C are rear, side, and cross-sectional views of a protective covering with side grips.
Figure 10C:
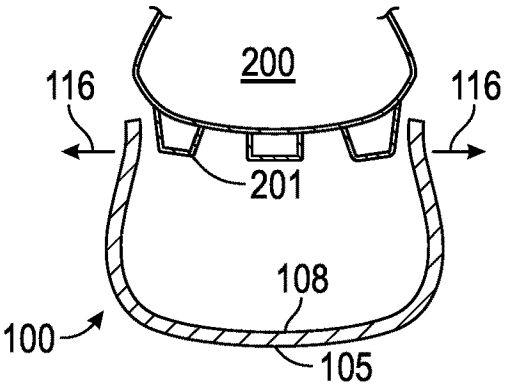
Figure 10A:
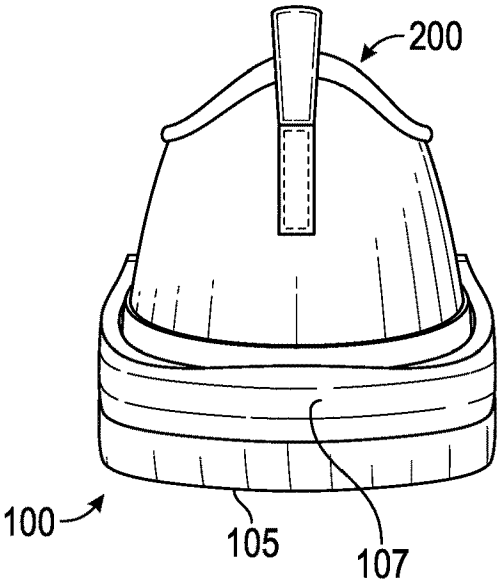
Figure 11:
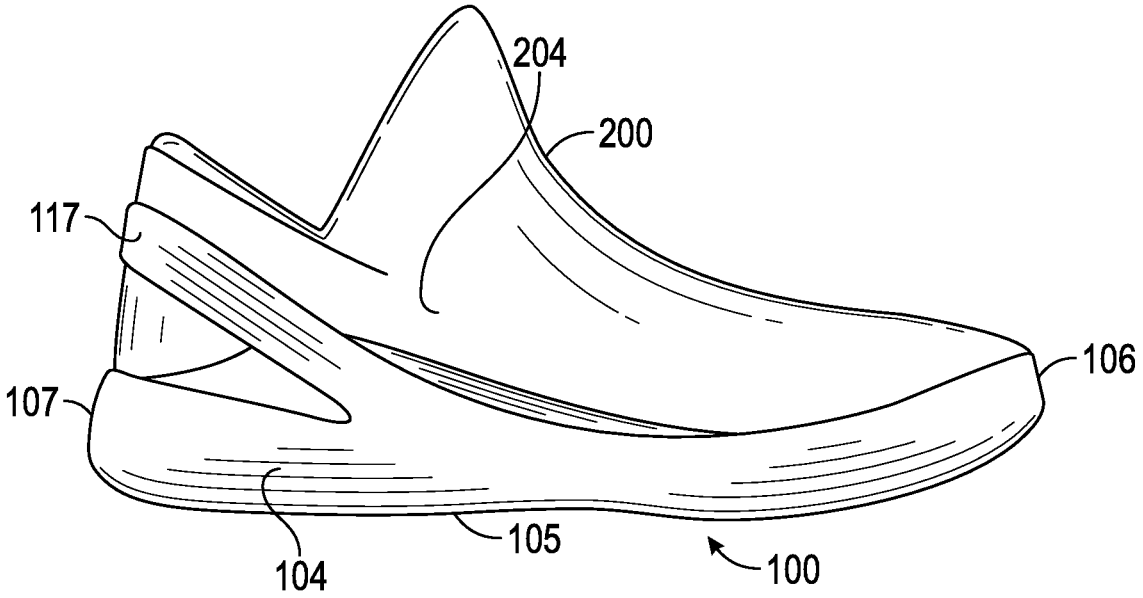
FIG. 11 is a side view of a protective covering having a rear strap grip.
Figure 12:
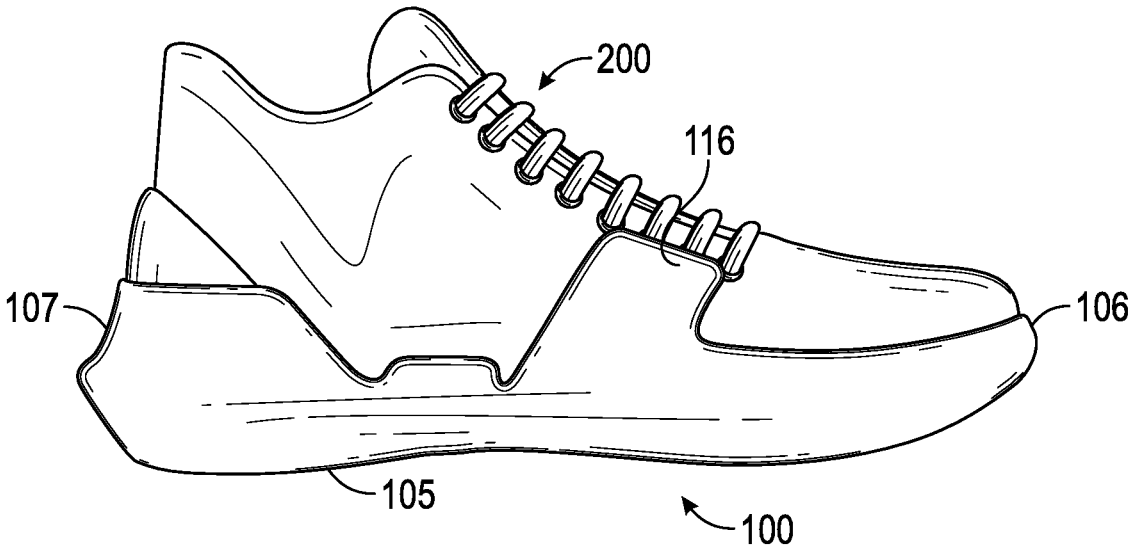
FIG. 12 is a side view of a protective covering having side grips.

FIG. 10A-10C are rear, side, and cross-sectional views of a protective covering 100 with side grips 116. The side grips 116 may be flexible enough to allow a user to directly step into the covering without requiring additional interaction, yet rigid enough to return to apply pressure to the cleated shoe 200 and form a strong hold. The side grips 116 may be given additional rigidity by overmolding or embedding a U-shaped metal or other rigid material within the protective covering 100. The side view of FIG. 10B depicts how the side grips 116 may be positioned on the protective covering 100. These grips may optionally be located nearer to the rear of the protective covering 107 or the front of the protective covering 106, protruding from the protective covering 100 at any location around the side portion 104. The cross-sectional view in FIG. 10C illustrates how the side grips 116 would fit as the cleated shoe 200 is inserted into the protective covering 100. The rear view in FIG. 10A illustrates how the protective covering 100 may fit on the cleated shoe 200. FIG. 11 is a side view of a protective covering having a rear strap grip 117. The rear strap grip 117 may optionally protrude from any location on the side portion 104, such as the front, midfoot, or rear regions, and angled toward or around the heel portion 107. The rear strap grip 117 may be constructed of a single piece or a plurality of pieces that hold the protective covering 100 onto the cleated shoe 200. It may or may not connect around the heel of the shoe, depending on aesthetics and material of construction, which may be rubber, plastic, fabric, or metal. The strap grip 117 may be also be overmolded with a more rigid material such as metal, hard rubber, or hard plastic to provide rigidity. FIG. 12 is a side view of a protective covering having side grips 116 at the midfoot and a raised portion at the heel of the protective covering 107 which cups the heel of the cleated shoe 200. The side grips 116 of FIG. 12 may optionally form a full closure around the shoe or alternatively only partially close around the shoe and operate by friction, pressure, or adhesion.

Figure 14:
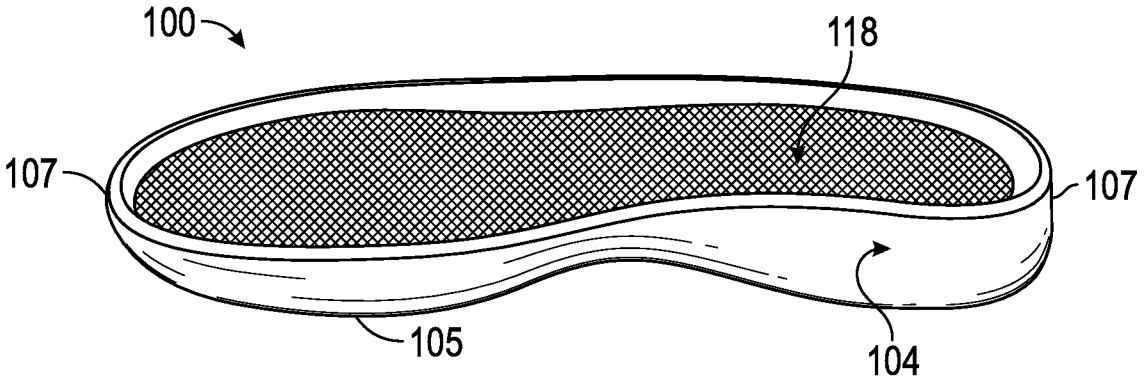
FIG. 14 is a side view of a protective covering having a thermoplastic layer.

FIG. 14 is a side view of a protective covering 100 having a thermoplastic layer 118 that softens at an elevated temperature. This thermoplastic layer 118 may optionally soften around the boiling point of water, similar to boil-and-bite mouth guards used in many athletic sports. Upon softening, a user may step a cleated shoe 200 into the thermoplastic layer 118 to form a matching mold for the cleated shoe 200 that fits snugly. If the protective covering 100 loosens over time, or the user desires to use the protective covering 100 with a different pair of cleated shoes 200, the covering 100 may be re-heated and molded to the cleated shoe 200 again.

Figure 15:
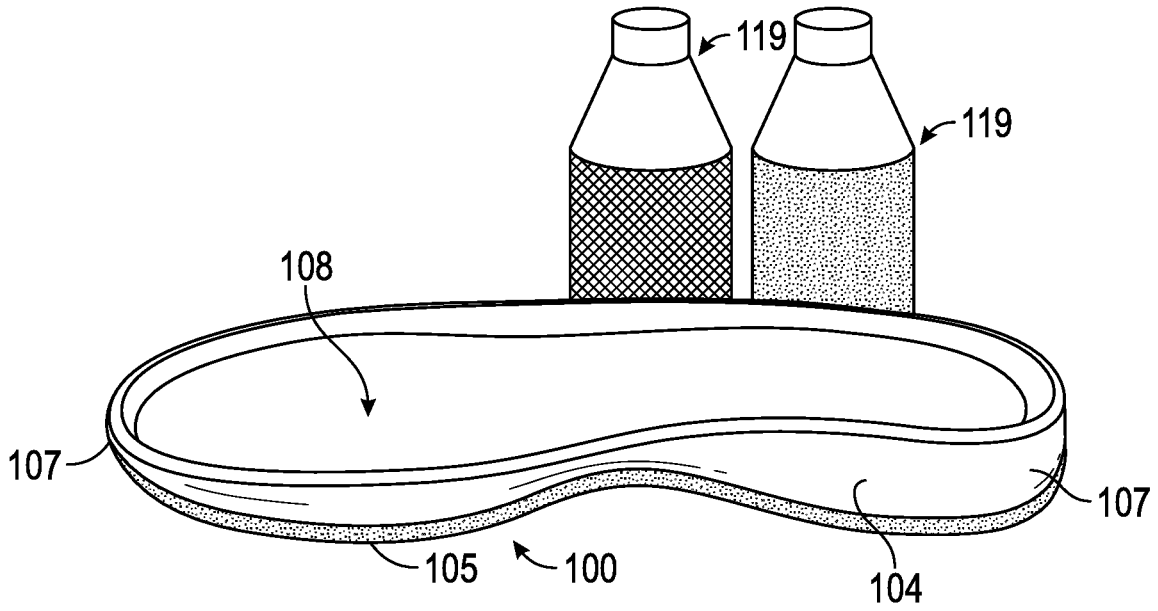
FIG. 15 is a side view of a protective covering having a moldable material.

FIG. 15 is a side view of a protective covering 100 having a moldable material 119 capable of being poured into the shoe-side footbed 108 of the protective covering 100. Once the moldable material 119 is poured into the footbed 108, the user may step into the moldable material 119 to make a mold of the user's cleated shoe 200. The user may then wait for the moldable material 119 to set and harden at room temperature, or may optionally be required to heat the moldable material 119 to a heightened temperature, such as one obtainable in a home oven, to set, polymerize, or otherwise cause the moldable material 119 to cure. The moldable material 119 may be a thermosetting material such as an epoxy resin, a silicone, a polymer, foam, or other soft material with the capacity to cure or harden over time.

Figure 16:
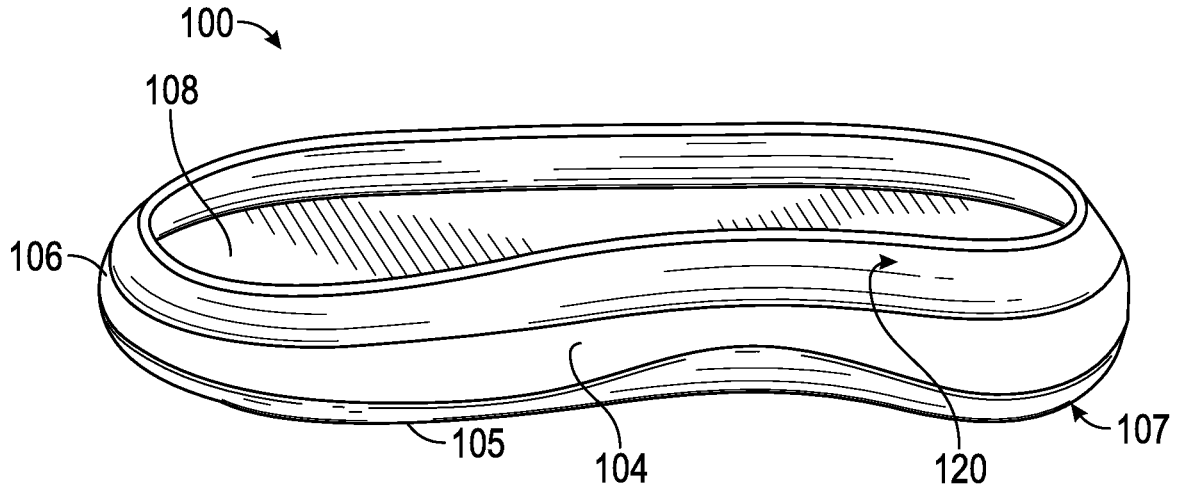
FIG. 16 is a side view of a protective covering having a heat shrink grip structure.

FIG. 16 is a side view of a protective covering 110 having a heat shrink grip structure 120. The heat shrink grip structure 120 extends from the outer sides of the protective covering 104 and narrows to hold a cleated shoe when inserted into the protective covering. This heat shrink grip structure 120 may be constructed of an elastic and flexible material that shrinks when heat is applied. Originally, the heat shrink grip structure 120 may be oversized to fit around a cleated shoe 200, but narrows when heat is applied. The heat shrink grip structure may retain its flexibility and elasticity after heat is applied, so a user can adjust desired tightness of the protective covering 100 by exposing the heat shrink grip structure 120 to a greater or lesser amount of heat.

As noted above, the protective covering may also be formed from multiple materials, potentially layered, wherein a second material is positioned on top of a first material. These materials could be a variety of foam, rubber, polymer, thermoplastic, or even more rigid footwear materials like carbon fiber, plastic, leather, wood, or metal. These may be the same materials used in the manufacture of traditional non-cleated athletic shoes. Instead of holes and recesses in the top of the protective covering, a layer of a second material may be provided that deforms to accept the cleats and other formations on the bottom of the cleated shoe. In this embodiment, the protective covering could be provided as a cut-to-size or one-size-fits-all product for consumers to adjust accordingly to their footwear. This second material may retain the shape of the bottom of the cleated shoe, customizing itself to the particular shoe after a single use. Additionally, the entire protective covering may be constructed of a second material that conforms to the bottom of the cleated shoe when a user presses his or her cleated shoe into it. Creating the entire protective covering of a single material may provide sufficient cushioning for the cleated shoe and simplify the process of constructing the covering.

The protective covering may be constructed of durable materials for prolonged use, or from less-durable materials for limited use. Protective coverings made from materials for light use may be appealing to the owner of a building or other location who wishes to keep his or her floors safe by providing protective coverings to visitors in cleated shoes. Such owners may be schools and universities, golf courses, and other locations where customers or visitors may commonly use cleated shoes. Durable materials, such as rubber, fabric, plastic, leather, wood, or metal, used in the manufacture of traditional non-cleated athletic shoes may be used to construct the protective coverings.

The protective covering 100 may be constructed of blown rubber, polyurethane foam, neoprene, thermal plastic elastomers, injected ethyl vinyl acetate foam, silicone, nylon, and other polymers and rubbers or combinations thereof. The protective covering may be made by injection molding or cast molding. The protective covering may also be formed by polymer extrusion deposition, binding of granular materials via sintering or melting by laser or electron beam, photopolymerization, laser powder forming, binder and material jetting, selective deposition lamination, and other 3-D printing methods. When constructed from customizable design methods, such as 3-D printing or CAD drawings used to create a mold or model, the user may be provided with the option to customize design features of the protective covering. For example, the user may be provided with a base design that includes the necessary holes or recesses offer sufficient protection based on the arrangement and style of cleats on the shoe. The user may then be provided with options to modify this base design to add logos, designs, or other features to the final protective covering.

The invention claimed is:

1. A protective covering for an athletic shoe, comprising:

a bottom portion comprising a first material configured to contact the ground or other walking surface;

a front toe portion configured to fit a front of the athletic shoe, the front toe portion configured to wrap around and hold a toe of the athletic shoe;

a rear heel portion configured to fit a heel of the athletic shoe, the heel portion configured to wrap around and hold the heel of the athletic shoe;

two outer side portions running along the sides of the protective covering, the side portions being contoured such that the protective covering is shaped to receive either a left or right shoe; and a plurality of flexible, semi-rigid teeth gripping structures configured to grip the athletic shoe and hold the athletic shoe by friction during movement, the teeth gripping structures protruding from the side portions in a manner to contact at least a portion of the side of the athletic shoe, the teeth gripping structures running from the heel portion to the toe portion above the two outer side portions, wherein at least two of the teeth gripping structures differ in length, and wherein the protective covering is open in a space between the plurality of teeth gripping structures protruding from the side portions.

2. The protective covering of claim 1, wherein the plurality of teeth gripping structures includes at least two teeth gripping structures located near the heel portion and at least two teeth gripping structures located near the front toe portion, and wherein the teeth gripping structures located near the heel portion are longer than the teeth gripping structures located near the toe portion.

3. The protective covering of claim 1, further comprising a shoe-facing footbed portion on top of a shoe-facing side of the bottom portion, the shoe-facing footbed portion comprising a second material that deforms to accept the cleats and other formations on the bottom of the cleated shoe, the shoe-facing footbed portion configured to receive the bottom of the athletic shoe.

4. The protective covering of claim 3, wherein the shoe-facing footbed portion comprises an array of recesses and configured to receive protrusions form the bottom of the athletic shoe and dimensioned such that the protrusions do not extend through the bottom portion.

5. The protective covering of claim 4, wherein the array of recesses is configured to match a pattern of an array of protrusions on the bottom of a shoe.

6. The protective covering of claim 3, wherein the shoe-facing footbed comprises an adhesive material positioned to adhere to the bottom of the athletic shoe when the protective covering is attached to the athletic shoe.

7. The protective covering of claim 1, wherein the teeth gripping structures comprise an adhesive material positioned to adhere to the athletic shoe when the protective covering is attached to the athletic shoe.

8. The protective covering of claim 1, wherein the bottom portion includes one or more stretch areas that allow the protective covering to expand longitudinally.

9. The protective covering of claim 1, wherein the protective covering is partially translucent or transparent so the design of the cleated shoe is visible through the covering.

10. The protective covering of claim 1, wherein the protective covering possess a loop at the rear heel portion of the protective covering.

11. A protective covering for an athletic shoe, comprising:

a bottom portion comprising a first material configured to contact the ground or other walking surface;

a front toe portion configured to fit the front of the athletic shoe;

a rear heel portion configured to fit the heel of the athletic shoe;

two outer side portions running along the sides of the protective covering, the side portions being contoured such that the protective covering is shaped to receive either a left or right shoe;

a shoe-facing footbed portion on top of the shoe-facing side of the bottom portion, configured to receive the bottom of the athletic shoe, the shoe-facing footbed portion comprising a second material;

a plurality of pairs of flexible, semi-rigid teeth gripping structures configured to grip the athletic shoe and hold the athletic shoe during movement by friction, wherein each pair of teeth gripping structures includes teeth gripping structures located opposite each other on each of the two outer side portions and wherein the protective covering is open in a space between the plurality of pairs of teeth gripping structures; and wherein one or more of the front toe portion, rear heel portion, outer side portions, and shoe-facing footbed portion are configured to grip the athletic shoe.

12. The protective covering of claim 11, wherein the second material is a thermoplastic material or a thermosetting material.

13. The protective covering of claim 11, wherein the two outer side portions comprise side grips.

14. The protective covering of claim 11, wherein the front toe portion, the rear heel portion, and two outer side portions each comprise a heat shrink grip structure.

* * * * *